US009318247B2

(12) United States Patent
Schiepp et al.

(10) Patent No.: US 9,318,247 B2
(45) Date of Patent: Apr. 19, 2016

(54) ELECTROMAGNETIC ACTUATING DEVICE

(75) Inventors: Thomas Schiepp, Seitingen-Oberflacht (DE); Stefan Schoeller, Tengen (DE); Joerg Buerssner, Engen (DE); Peter Vincon, Stockach (DE)

(73) Assignee: ETO Magnetic GmbH, Stockach (DE)

( * ) Notice: Subject to any disclaimer, the term of this patent is extended or adjusted under 35 U.S.C. 154(b) by 112 days.

(21) Appl. No.: 13/810,566

(22) PCT Filed: Jun. 29, 2011

(86) PCT No.: PCT/EP2011/060901

§ 371 (c)(1),
(2), (4) Date: Jan. 16, 2013

(87) PCT Pub. No.: WO2012/007279

PCT Pub. Date: Jan. 19, 2012

(65) Prior Publication Data

US 2013/0113582 A1 May 9, 2013

(30) Foreign Application Priority Data

Jul. 16, 2010 (DE) ..... 20 2010 010 371 U

(51) Int. Cl.

*H01F 7/08* (2006.01)
*H01F 7/121* (2006.01)
*F01L 1/047* (2006.01)
(Continued)

(52) U.S. Cl.

CPC ..... *H01F 7/121* (2013.01); *F01L 1/047* (2013.01); *F01L 13/0036* (2013.01); *H01F 7/1646* (2013.01); *H01F 7/1844* (2013.01); *F01L 2013/0052* (2013.01); *F01L 2820/031* (2013.01)

(58) Field of Classification Search

CPC ..... H01F 7/1646
USPC ..... 335/229
See application file for complete search history.

(56) References Cited

U.S. PATENT DOCUMENTS 4,035,789 A * 7/1977 Akita et al. ..... 340/618
4,690,371 A 9/1987 Bosley et al.
(Continued)

FOREIGN PATENT DOCUMENTS

CN 101689419 3/2010
DE 199 35 428 7/2000
(Continued)

OTHER PUBLICATIONS

Chinese Office action for Application No. 201180044489.7 dated Jul. 14, 2015.
(Continued)

*Primary Examiner* — Alexander Talpalatski
(74) *Attorney, Agent, or Firm* — Bachman & LaPointe, PC

(57) ABSTRACT

An electromagnetic actuating device, in particular camshaft adjustment device, having an armature unit (14) which can be driven in the axial direction or parallel thereto in reaction to energization of a stationary, axially oriented coil unit (10) and is designed to interact with a slide and/or plunger unit (16) which extends in the axial direction, in particular a plunger unit which brings about camshaft adjustment of an internal combustion engine, wherein permanent magnet means are provided on and/or in the armature unit and/or the slide or plunger unit, and the coil unit and armature unit are accommodated at least partially in a housing unit or carrier unit.

12 Claims, 3 Drawing Sheets

(51) Int. Cl.

| | |
|---|---|
| ***F01L 13/00*** | (2006.01) |
| ***H01F 7/16*** | (2006.01) |
| ***H01F 7/18*** | (2006.01) |

(56) References Cited

U.S. PATENT DOCUMENTS

| | | | | |
|---|---|---|---|---|
| 6,718,919 | B2 * | 4/2004 | Muraji | 123/90.11 |
| 6,967,550 | B2 | 11/2005 | Elendt et al. | |
| 7,628,378 | B2 | 12/2009 | Adams et al. | |
| 8,176,887 | B2 * | 5/2012 | Golz et al. | 123/90.48 |
| 8,339,225 | B2 * | 12/2012 | Nendel | 335/229 |
| 8,448,615 | B2 * | 5/2013 | Laufenberg et al. | 123/90.11 |
| 8,493,166 | B2 * | 7/2013 | Golz et al. | 335/264 |
| 8,729,992 | B2 * | 5/2014 | Schiepp et al. | 335/229 |
| 2010/0192885 | A1 * | 8/2010 | Golz et al. | 123/90.17 |
| 2011/0133576 | A1 * | 6/2011 | Golz et al. | 310/12.32 |
| 2011/0248804 | A1 * | 10/2011 | Wygnanski | 335/230 |
| 2011/0267159 | A1 * | 11/2011 | Schiepp et al. | 335/232 |
| 2012/0031360 | A1 * | 2/2012 | Laufenberg et al. | 123/90.17 |

FOREIGN PATENT DOCUMENTS

| | | | |
|---|---|---|---|
| DE | 19935428 | C1 | 7/2000 |
| DE | 20114466 | U1 | 1/2002 |
| DE | 102006035225 | A1 | 2/2007 |
| DE | 102008019398 | A1 | 11/2008 |
| DE | 202009015468 | U1 | 2/2010 |
| DE | 202009006940 | U1 | 9/2010 |
| FR | 2886485 | A1 | 12/2006 |
| WO | 2008/155119 | | 12/2008 |

OTHER PUBLICATIONS

Chinese Office action for Application No. 201180044489.7 dated Apr. 14, 2015.

* cited by examiner

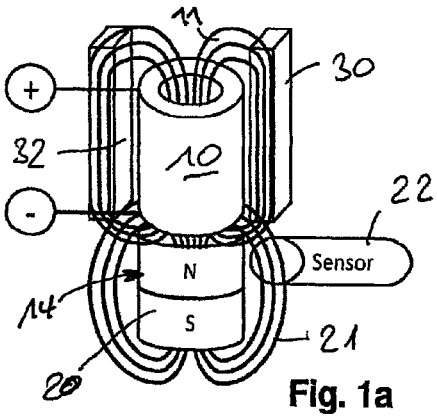
Fig. 1a
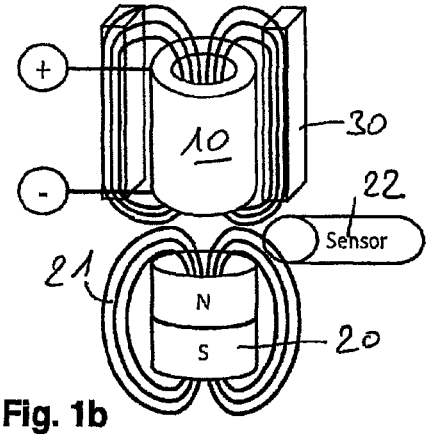
Fig. 1b
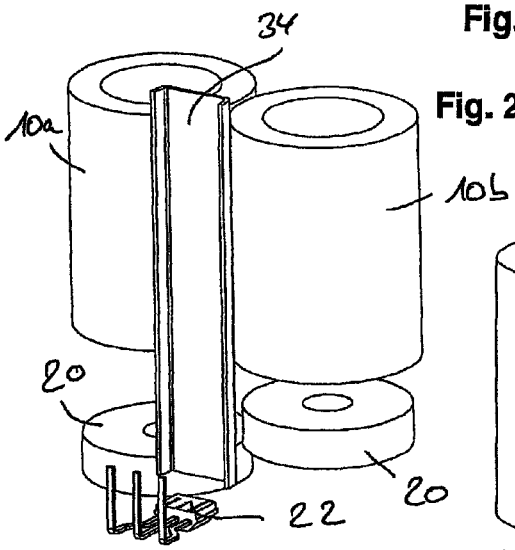
Fig. 2
Fig. 3
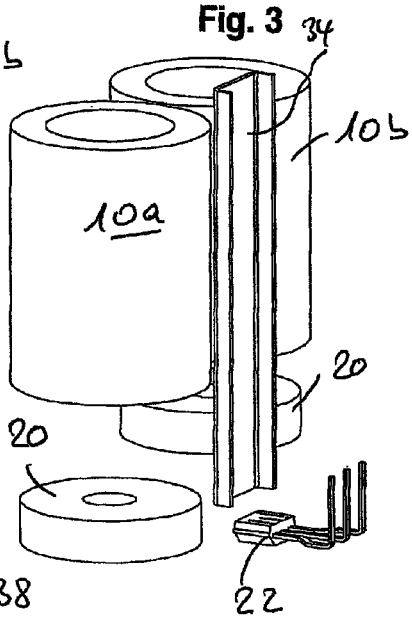
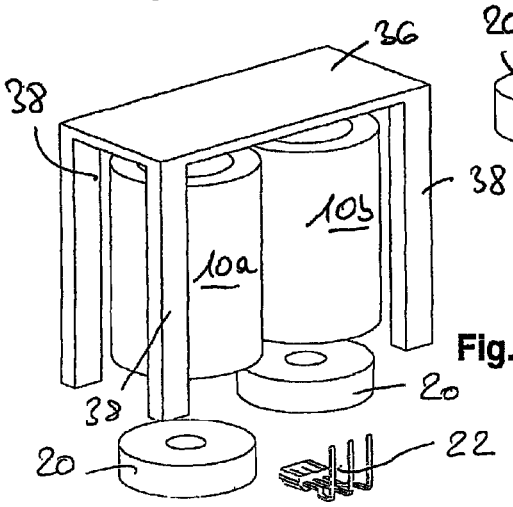
Fig. 5

ELECTROMAGNETIC ACTUATING DEVICE

BACKGROUND OF THE INVENTION

The present invention relates to an electromagnetic actuating device. For example, such devices are known from German Utility Model 201 14 466, and are suitable for numerous actuating devices. A known application for such a device involves camshaft adjustment; the slide or plunger unit connected with the movable armature unit here acts on a camshaft of an internal combustion engine, thereby creating a desired adjustment functionality.

It is precisely within the context of an internal combustion engine or similar field of application that reliable operation becomes especially critical, wherein the special environmental conditions (high temperature, vibration, potentially frosty engine) can lead to occasional malfunctions, which have to be reliably detected. Correspondingly, so-called reset acquisition technologies are known from prior art for electromagnetic actuating device, wherein an induction signal of the armature unit moving in accordance with the camshaft position that was acquired and evaluated with the coil unit in a deenergized state is evaluated on the terminals of the coil unit. For example, DE 10 2006 035 225 A1 of the applicant shows this type of device.

However, the disadvantage to this technology in conjunction with other similar approaches from prior art not delved into in any greater detail here is that a malfunction can only be ascertained from a respective terminal signal with difficulty, which accordingly makes downstream evaluation electronics complicated and itself prone to failure in turn. Add to the above the disadvantage that this known induction technology can by principle only detect a movement by the plunger or armature unit, but not a respective plunger position; in particular, means for evaluating an induction coil voltage do not make it possible to reliably acquire a (standing) end position of the plunger, for example as it engages into the camshaft.

Accordingly, Utility Model Application 20 2009 006 940 of the applicant, which had not yet been public at the time of the present application, alternatively proposes that a coil voltage (induced by the permanent magnet unit) for acquiring the position of the armature be measured by providing stationary sensors (as magnetic field detecting means) in a housing or carrier unit of the actuating device, which act in conjunction with the permanent magnet means in a magnetically detecting manner, and output an accompanying magnetic field detection signal for further processing in response to a movement or position of the permanent magnet means (for example, corresponding to a movement or position of the armature unit). This signal is initially independent of an energized or non-energized state of the coil unit, and in particular also independent of a moving or idle situation of the armature, as illustrated by FIG. 9 for the drawn upon internal prior art from this utility model application: a housing unit (not shown) incorporates a stationary coil unit 10, which is formed around a stationary core 12. Mounted so that it can move in an axial direction (i.e., in the longitudinal direction on FIG. 9) relative to these stationary units is an armature unit 14 fitted with a plunger unit 16, whose engaging end 18 is designed in an otherwise known manner for interacting with a groove of a camshaft adjuster.

The armature unit 14 exhibits a (disk-shaped) permanent magnet unit 20, which is axially magnetized in the manner depicted, and situated opposite the core unit 12 in such a way that, in response to energizing the coil unit 10, the armature unit 14 in conjunction with the fitted plunger unit (held on the latter rigidly or detachably by the retaining force of the permanent magnet unit 20) is moved in an axial direction (i.e., downward on FIG. 9).

In order to realize the position detection, the permanent magnet unit 20 in this internal prior art has allocated to it a stationary sensor unit 22 (suitably provided in the housing not shown on the figures), which detects the permanent magnetic field and, realized as a Hall sensor, for example, can acquire this magnetic field and its change and relay it to a subsequent electronic evaluation by moving the armature unit 14.

As a result, this solution is able to overcome the principle-related disadvantages of the published prior art discussed above.

However, improvements are needed even for the kind of solution that was generically and schematically depicted based on FIG. 9 and must then of course be specifically configured to suit the individual case. The idealized state of the schematic representations on FIG. 10*a* (donned state of armature unit 14, only its permanent magnet disk (20) is shown) or on FIG. 10*b* (removed state of armature unit) of the schematically depicted coil unit 10 with core 12 show that the sensor unit 22 can effectively arrive at a good positional differentiation via a respectively varying field progression 21 of the permanent magnet unit 20 relative to the fixed sensor unit 22 (wherein the schematic signal diagram according to FIG. 10*b* in this regard also illustrates the progression of movement in terms of the drop relative to the level on FIG. 10*a*).

However, taking into account a coil field always present when the coil unit 10 is being energized (see field lines 11 in this regard), it turns out that the latter can cause the sensor unit 22 to malfunction when overlapped. This is because in particular the magnetic field lines of the coil field 11 overlap a possible detection state in the deenergized state (FIG. 11*b*) of the armature unit, so that this armature position might not be correctly detected by the sensor unit 22 in a case where energized.

Known from DE 10 2008 019 398 A1 is an electromagnetic actuating device with an armature unit that can be driven along or parallel to the axial direction in response to energizing a stationary, axially aligned coil unit, and is designed to interact with a slide and/or plunger unit extending in the axial direction, wherein permanent magnetic means are provided on and/or in the armature unit and/or the slide or plunger unit, and the coil unit and armature unit are at least partially accommodated in a housing or carrier unit, wherein the carrier unit has allocated to it stationary magnetic field detecting means that are designed for contactless magnetic interaction with the permanent magnetic means and configured in such a way that an axial position of the armature unit and/or the slide or plunger unit can be electronically ascertained in an energized and non-energized state of the coil unit by evaluating a magnetic field detection signal of the magnetic field detecting means, and the coil unit has allocated to it magnetic flux-directing means in such a way that it can dissipate a magnetic coil field generated by the coil unit away from the magnetic field detecting means and/or weaken it relative thereto.

With respect to further prior art, we refer to DE 199 35 428 C1 as well as U.S. Pat. No. 4,690,371.

Therefore, the object of the present invention is to improve the detection characteristics of a generic device that additionally exhibits stationary magnetic field detecting means for interaction with permanent magnet means moved by armature motion so as to detect position and movement, in particular to overcome any damaging influence by a magnetic coil field.

SUMMARY OF THE INVENTION

The object is achieved by the electromagnetic actuating device of the invention.

In a manner advantageous according to the invention, the described device, more precisely the coil unit, additionally has allocated to it flux-directing means, which are designed in such a way as to suitably dissipate or shield a magnetic coil field generated by the coil unit in an energized state away from the magnetic field detecting means, and/or weaken it relative to the magnetic field detecting means. Therefore, the object of the present invention is to improve the detection characteristics of a generic device that additionally exhibits stationary magnetic field detecting means for interaction with permanent magnet means moved by armature motion so as to detect position and movement, in particular to overcome any damaging influence by a magnetic coil field.

This is especially advantageously realized by having the flux-directing means take the form of flux-directing elements consisting of a magnetically conductive material, e.g., soft iron, and situate them adjacent to the coil unit and/or running axially parallel to the latter in such a way as to bundle the coil magnetic field in these flux-directing elements, thereby shielding or weakening the (coil) magnetic field on the sensor unit. According to the invention, this then leads to the intended improvement of the motion or position measuring process involving these sensors (magnetic field detecting means).

Within the framework of preferred exemplary embodiments, it is particularly preferred that such a flux-directing element (whether by itself, in a group and further preferred joined with a shared plate, e.g., frontally situated in relation to the coil unit) be elongated in design, further preferably be shaped like a plate or section, and arrange the latter relative to the magnetic field sensor in such a way that the sensor suitably lies outside, roughly frontally, from a flux-directing, bundling or shielding space generated by the flux-conducting means, so that it can interact unimpaired with the permanent magnet means on the armature side.

Provided within the framework of preferred forms of realization, for example, is to arrange several oblong flux-directing elements axially parallel to the coil device(s) so as to envelop the edges or corners of a coil device or several adjacent coil devices like a cage, wherein it is further preferred that these flux-directing elements extend along the axial coil length, at which time the sensor unit frontally opposes this arrangement (or a single flux-directing element in the axial extension). On the frontal end of the flux-directing elements lying opposite the sensor unit, a flat conducting element (again connected so as to direct a flux) can then be suitably provided for all flux-directing elements.

Alternatively and within the framework of additional preferred embodiments of the invention, it is beneficial to respectively allocate a shell that realizes the magnetic flux-directing means and consists of a magnetically conductive material, such as soft iron, to an individual coil unit or several coil units on the jacket side, either individually or in combination; this shell can then be bent roughly cylindrically or in cylindrical sections, and in a further development additionally exhibit an axially extending, oblong shielding plate as the flux-directing element, for example in the case of a coil pair.

Within the framework of preferred forms of realization for the invention, the slide or plunger unit is here detachably joined with the armature unit, and specifically in such a way that the permanent magnetic force exerted by the permanent magnet means holds the plunger unit (detachably) to the armature unit. As a result, the permanent magnet unit is exposed to a multiple synergistic effect: on the one hand, its repelling force when the coil is energized ensures that the armature moves within the framework of the electromagnetic actuating function of the actuating device. On the other hand, as discussed, it provides the opportunity to use the stationary magnetic field detecting means (for example, realized as a stationary sensor unit) to reliably detect an armature motion and position at any time, while the permanent magnet unit additionally and advantageously establishes the reliable and at once detachable connection between the slide or plunger unit and armature unit (for example, in a preferred case by virtue of the fact that the armature unit itself exhibits suitable permanent magnet means, e.g., a correspondingly magnetized disk, and the plunger unit then consists of magnetically conductive material, e.g., soft iron).

Within the framework of the present invention, this arrangement is magnetically shielded against whatever influences of the coil magnetic field might potentially disrupt sensor acquisition.

While using a Hall sensor or similar magnetic field detectors for the magnetic field detecting means does lie within the framework of preferred forms of realization for the invention, the present invention is not limited thereto; rather, numerous approaches and options are available for realizing a magnetic field sensor for the magnetic field detecting means and suitably providing it in the housing next to the armature unit. The magnetic field detector exhibiting a magnetic field sensor can be at least partially enveloped by an in particular polymeric extruded or encapsulated mold formed in the housing or carrier unit.

While the present invention can in principle also be favorably realized for a simple configuration comprised of a single coil with an armature unit allocated thereto and a corresponding sensor, the present invention is not limited to such a configuration, with it rather lying within the framework of preferred forms of realization for the invention to provide a plurality of coil units, as well as a plurality of armature units running axially parallel or skewed relative to each other, which in turn have coil units allocated to them in a suitable manner, wherein either individual flux-directing elements can then be provided here for a shared sensor, or multiple flux-directing elements for a shared sensor, or multiple flux-directing elements can shield several sensors, or a coil field for the latter can be suitably influenced.

As a result, the present invention makes it possible to improve the technology already known from internal prior art in terms of its detection characteristics, in particular its insensitivity to any magnetic field influences of the energized coil, in a surprisingly simple and effective way, and thereby to also make the present invention accessible in demanding or problematic conditions of use in terms of magnetic flux.

BRIEF DESCRIPTION OF THE DRAWINGS

Additional advantages, features and details of the invention may be gleaned from the description of preferred exemplary embodiments based on the drawings; the latter show:

FIG. 1*a*, 1*b* a schematic diagram to illustrate how a pair of flux-directing elements according to the invention act as magnetic flux-directing means in terms of effectively shielding a magnetic coil field against a stationary magnetic field detector unit;

FIG. 2, 3 a schematic view of the electromagnetic actuating device, reduced to a coil pair, a permanent magnet disk pair as the armature, a flux-directing plate as well as a magnetic field sensor to illustrate a possible first form of realization for the invention;

FIG. 5 a view similar to FIG. 2, 3 of a third exemplary embodiment of the invention;

DETAILED DESCRIPTION

Figure 11A:
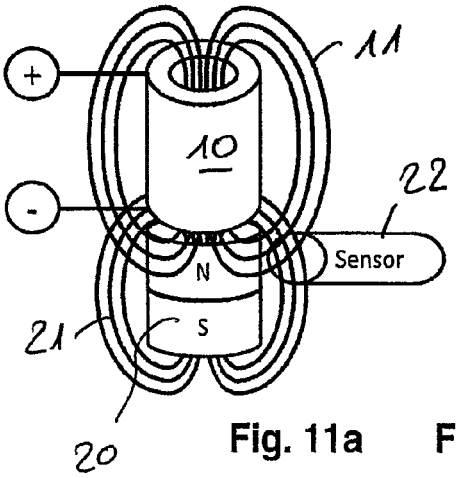
Figure 11B:
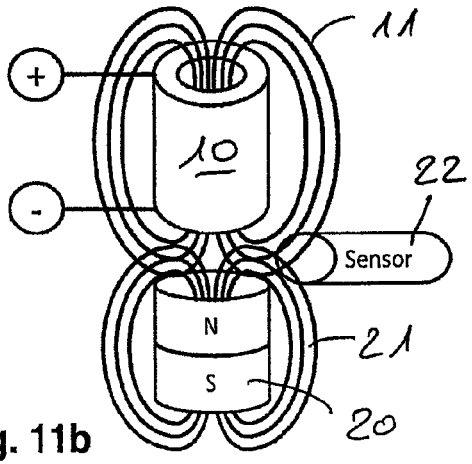

Similarly to the view on FIG. 11*a*, 11*b* regarding internal prior art, the comparison on FIG. 1*a*, 1*b* (once more for the energized state of the armature unit (FIG. 1*a*), with armature unit 14 as the permanent magnetic unit 20 at the top of the image on the coil 11, and in the deenergized state on FIG. 1*b*, with the armature unit (again with only the permanent magnetic unit 20 shown) at the bottom of the figure plane) illustrates that elongated flux-directing elements 30, 32 provided additionally and adjacent to the coil unit 10, which extend axially parallel to the longitudinal axis through the coil unit 10 (which to this extent also describes the axis of motion for the armature), bundle the coil magnetic field 11 generated by energizing the coil in its flux-directing elements. In the practical geometric realization on FIG. 1*a*, 1*b*, the effect of this is that the coil magnetic field does not extend as far in an axial direction, and thus no longer reaches the sensor 22 (or its sensitivity range). As a result, the positional difference of the armature is only acquired based on the changed permanent magnetic field 21 in the deenergized state (FIG. 1*b* in comparison to FIG. 11*b*), and in particular the coil magnetic field 11 no longer exerts any influence whatsoever on sensor detection.

In a specific realization, for example in the first exemplary embodiment on FIG. 2, 3 with an axially parallel coil pair 10*a*, 10*b* and correspondingly accompanying armature pair (again reduced to the view of the permanent magnet 20), wherein both units are energized—and hence operable—separately from each other, it turns out that the flux can be effectively influenced by an elongated flux-directing element 34 shaped like a U-profile in the exemplary embodiment, which extends along the direction of extension of coils 10*a* or 10*b*, and even as far as into a region in which the armature begins to move; the magnetic field sensor 22, a Hall sensor in the exemplary embodiment shown, here sits on the front side of the shielding flux-directing plate 34 made out of soft iron, so that it can interact uninfluenced with the permanent magnetic fields of the (again axially magnetized) units 14*a*, 14*b*, but remains largely uninfluenced by the coil magnetic fields in the energized state of the coils 10*a* or 10*b*.

Figure 4:
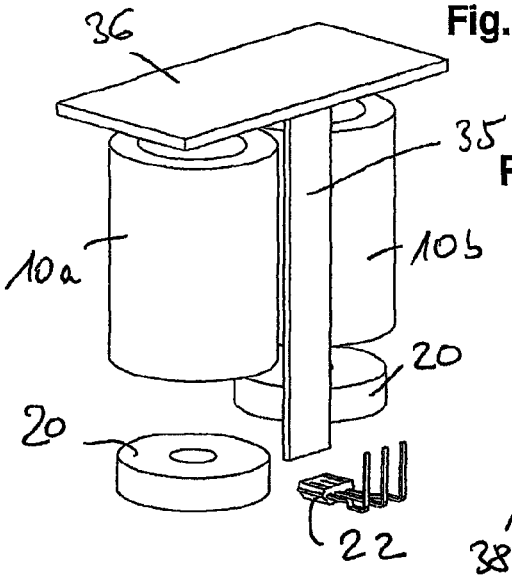
FIG. 4 a view similar to FIG. 2, 3 of a second exemplary embodiment of the invention.

The same holds true for a second exemplary embodiment according to FIG. 4 as a modification of the first exemplary embodiment. Here as well, the sensor unit 22 rests on the end side and front side of the flux-directing element 35, which is here lamellar and planar, and here again extends longitudinally; in addition, a shielding plate 36 is oppositely provided on the front side to further influence the flux of the coil magnetic field of the coil pair 10*a*, 10*b*.

In another alternative according to the third exemplary embodiment of FIG. 5, the individual flux-directing element 34 is here replaced by a group of four cross-sectionally square flux-directing elements 38, which are connected at one end by means of the shielding plate 36, and span a square interior space accommodating the pair of coil units 10*a*, 10*b*, thereby ensuring an effective magnetic flux influence, while the sensor unit 22 is in turn held outside the spanned interior space so as to interact with the armature units (or permanent magnetic disks 20 provided there).

Figure 6:
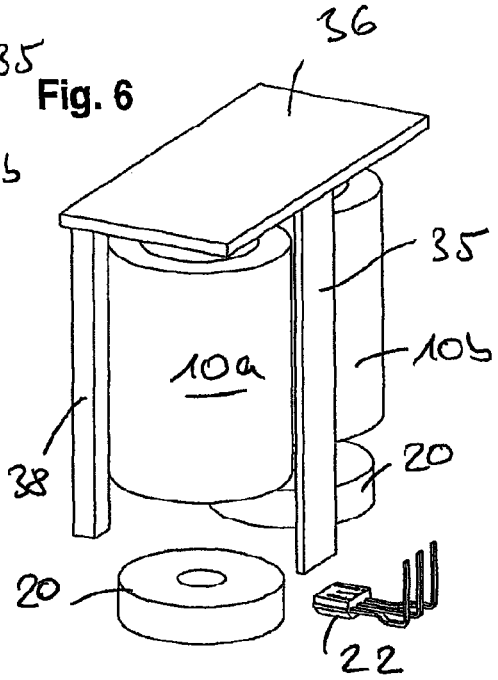
FIG. 6 a view similar to FIG. 2, 3 of a fourth exemplary embodiment of the invention.

The fourth exemplary embodiment on FIG. 6 shows a conceptual link between exemplary embodiments two (FIG. 4) and three (FIG. 5); the flux-directing elements are here realized out of a pair of corner rods 38 with a square cross section, as well as a directing plate 34 provided between the pair of coils 10*a*, 10*b* (similarly to FIG. 4).

Figure 7:
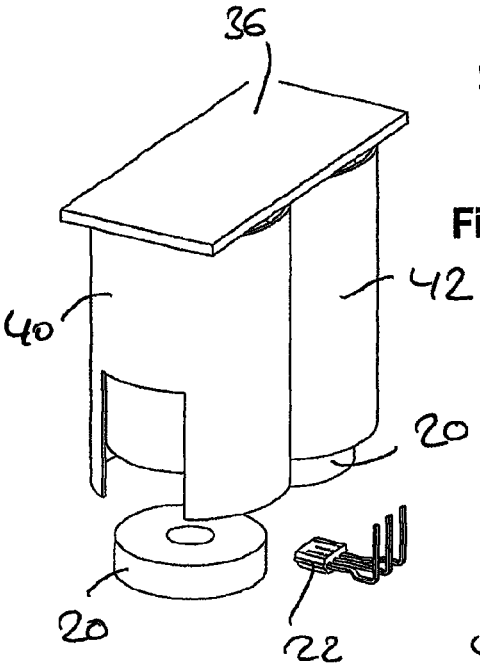
FIG. 7 a view similar to FIG. 2, 3 of a fifth exemplary embodiment of the invention.

The fifth exemplary embodiment according to FIG. 7 provides that both coils 10*a*, 10*b* are largely enveloped on the jacket side by shell elements 40, 42 resembling cylindrical sections, which at the end opposite the sensor unit 22 are in turn combined at the plate 36 so as to direct flux. The shells 40, 42 made out of soft iron ensure a predetermined flux progression, and achieve an effect analogous to the principle according to FIG. 1*a*, 1*b*.

Figure 8:
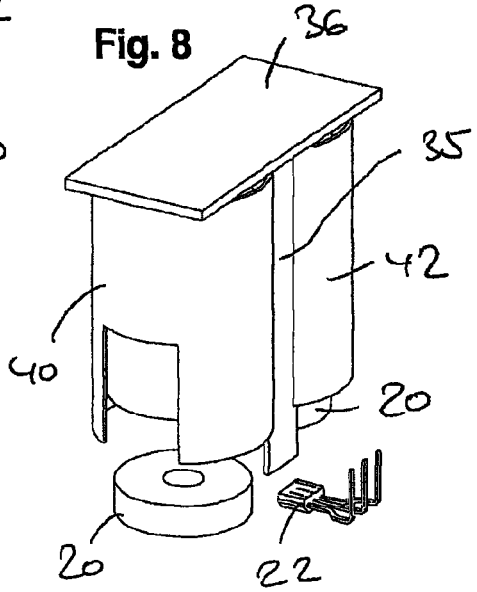
FIG. 8 a view similar to FIG. 2, 3 of a sixth exemplary embodiment of the invention.
Figure 9:
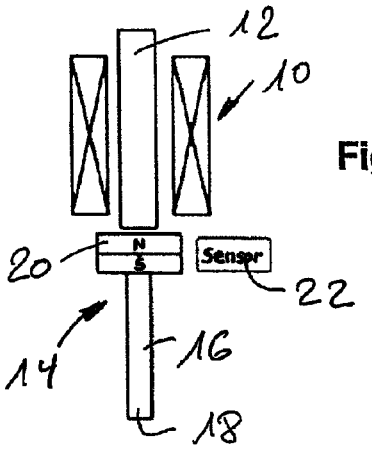
FIG. 9 a view depicting the structural design of an electromagnetic camshaft adjusting device as a schematic presentation with an armature unit, a plunger unit allocated thereto, as well as a sensor unit interacting with permanent means of the armature unit, according to internal prior art.
Figure 10A:
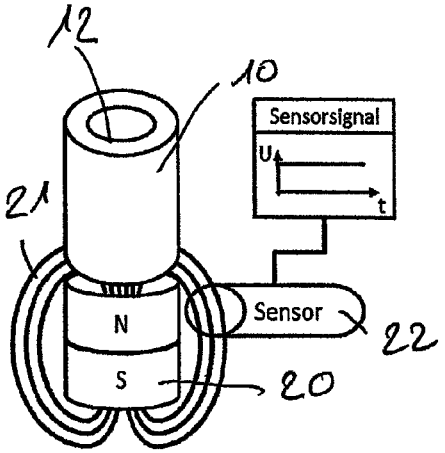
FIG. 10*a*, 10*b* a clarification of the idealized sensor functionality of the device according to FIG. 9, omitting a coil magnetic field, and FIG. 11*a*, 11*b* a view similar to FIG. 10*a*, 10*b*, additionally taking into account a coil magnetic field in the energized state of the coil that influences the sensor functionality.
Figure 10B:
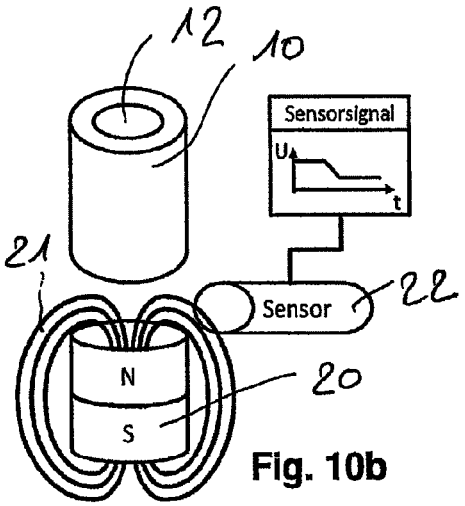

The same holds true for the sixth exemplary embodiment according to FIG. 8, which again combined the shells 40, 42 provided on the jacket side with an additional shielding plate 34 according to the second exemplary embodiment of FIG. 4.

All of these exemplary embodiments share in common that any influence by the coil magnetic field that might potentially detract from the sensor detection result can be very effectively suppressed or limited in the energized state of the coil at a comparatively low production outlay, without disadvantageous magnetic influences.

The invention claimed is:

1. An electromagnetic camshaft adjusting device, comprising:

an armature unit adapted to be driven along or parallel to an axial direction in response to energizing a stationary, axially aligned coil unit, the armature unit interacts with a slide and/or plunger unit extending in the axial direction, wherein the plunger unit causes a camshaft adjustment in an internal combustion engine;

permanent magnetic means on and/or in the armature unit, and adapted to energize the coil unit to drive the armature unit via the effect of magnetic repulsion, wherein the coil unit and armature unit are at least partially accommodated in a housing or carrier unit;

the carrier unit has allocated to it stationary magnetic field detecting means adapted for contactless magnetic interaction with the permanent magnetic means and configured in such a way that an axial position of the armature unit and/or the slide or plunger unit is electronically ascertained in an energized and non-energized state of the coil unit by evaluating a magnetic field detection signal of the magnetic field detecting means; and the coil unit has allocated to it magnetic flux-directing means in such a way that it dissipates a magnetic coil field generated by the coil unit away from the magnetic field detecting means, and wherein the magnetic field detecting means comprises a magnetic field sensor at least partially enveloped by a polymeric extruded or encapsulated mold formed in the housing or carrier unit.

2. The device according to claim 1, wherein the magnetic flux-directing means is adapted to extend adjacent to the coil unit and at least in sections axially parallel to the latter.

3. The device according to claim 1, wherein the magnetic flux-directing means is adapted as at least one flux-directing element to which the magnetic field detecting means exhibiting a magnetic field sensor are allocated on the front side.

4. The device according to claim 3, including a plurality of elongated flux-directing elements running parallel to each other as the flux-directing means, the flux-directing elements span an interior space that incorporates the at least one coil unit, wherein the magnetic field detecting means exhibiting a magnetic field sensor are situated outside the spanned interior space.

5. The device according to claim 3, wherein, at a front side opposite the magnetic field sensor, the at least one elongated flux-directing element is joined with a flux-directing carrier and/or shielding plate which extends into a plane running perpendicular to the axis.

6. The device according to claim 1, wherein the magnetic flux-directing means comprises at least one shell that is made out of magnetically conductive material and at least regionally envelops the coil unit on the jacket side.

7. The device according to claim 1, wherein the slide or plunger unit is detachably held on the armature unit by a permanent magnetic retention force exerted by the permanent magnet means.

8. The device according to claim 1, wherein a plurality of armature and/or slide or plunger units driven independently of each other are provided in the housing or carrier unit.

9. The device according to claim 8, wherein the plurality of armature units in the housing or carrier unit has allocated to it a shared or corresponding plurality of flux-directing elements, wherein the flux-directing means for each coil unit exhibit at least one axially parallel running, elongated flux-directing element.

10. The device according to claim 9, wherein a shared magnetic field sensor is provided as the magnetic field detecting means for at least two of the plurality of armature units.

11. The device according to claim 9, wherein at least one respective magnetic field sensor is provided as the magnetic flux-directing means for each of the plurality of armature units.

12. The device according to claim 1, wherein the stationary magnetic field detecting means is influenced by the permanent magnetic means and wherein the magnetic flux-directing means isolates the stationary magnetic field detecting means from the magnetic coil field generated by the coil unit.

* * * * *